United States Patent [19]

Takata et al.

[11] Patent Number: 4,462,517

[45] Date of Patent: Jul. 31, 1984

[54] FASTENER-ATTACHING APPARATUS

[75] Inventors: Akihiko Takata, Fujisawa; Yoshihiko Hasegawa, Kawasaki, both of Japan

[73] Assignee: Scovill Japan Kabushiki Kaisha, Tokyo, Japan

[21] Appl. No.: 377,292

[22] Filed: May 12, 1982

[30] Foreign Application Priority Data

Oct. 26, 1981 [JP] Japan ..... 56-170188

[51] Int. Cl.[3] ..... B65G 47/68

[52] U.S. Cl. ..... 198/451; 221/251; 221/301; 198/368

[58] Field of Search ..... 198/368, 451, 452, 530, 198/532, 565; 221/93, 251, 301, 114, 116, 124

[56] References Cited

U.S. PATENT DOCUMENTS 817,780 4/1906 Jones ..... 221/93

1,178,679 4/1916 Pullen ..... 221/251

FOREIGN PATENT DOCUMENTS 55-49163 12/1980 Japan .

*Primary Examiner*—Joseph E. Valenza

*Assistant Examiner*—Daniel Alexander

*Attorney, Agent, or Firm*—Seidel, Gonda & Goldhammer

[57] ABSTRACT

In a fastener-attaching apparatus equipped with a feeder for selectively delivering two different component pieces of fasteners from two separate feed hoppers to an attaching point, the improvement in the feeder which comprises a pair of tracks having a pair of vertically parallel fastener-guiding T-grooves which extend from the delivery openings of the two feed hoppers and terminate in vertically juxtaposed fastener discharge outlets, a shifting mechanism for selectively closing and opening the T-grooves of the tracks, a guide having a guide groove provided at right angles to the T-grooves and extending to the fastener-attaching point, with the fastener discharge outlets open in the guide groove, a fastener limiter slide located opposite to the discharge outlets and urged by a spring slidably and partly into the guide groove, the limiter slide having separate fastener-piece-receiving recesses corresponding, respectively, to the upper and lower discharge outlets, and a pusher bar slidable in the guide groove and which, when driven through the guide, causes the limiter slide to retract and pushes each fastener piece to the attaching point.

5 Claims, 12 Drawing Figures

FASTENER-ATTACHING APPARATUS

BACKGROUND OF THE INVENTION

This invention relates to an apparatus for attaching snap or other similar fasteners to garments, and more specifically to a feeder for such apparatus which selectively feeds two different fastener components from two automaticdelivery hoppers to the fastener-attaching point.

We previously provided a fastener-attaching apparatus, as disclosed in Japanese Patent Application Publication No. 49163/1980, which comprises three rotary hoppers for automatically delivering snap fasteners or the like for garments, one of the hoppers being used exclusively for supplying backing members for attaching female and male fastener pieces and the two others for supplying the female and male pieces respectively, a single feed track connected to the backingmember hopper and extended therefrom to a location in the vicinity of the fastener-attaching point, separate feed tracks provided for delivering the female and male pieces, and shifter means by which those tracks are selectably coupled to a single, common guide track extended to a location in the vicinity of the fastener-attaching point. Thus, a single fastener-attaching apparatus is made multifunctional, with functions of attaching female and male pieces of fasteners.

Although the apparatus of the prior invention functions excellently, the movement of the means for shifting the female-piece feed track to the male-piece one or vice versa into or out of either track is sometimes hampered because the both tracks are full of the fastener components. For this reason there has been a demand for a more positive, infallible shifter means. The published specification of the aforementioned invention also describes a modified arrangement in which the both tracks are simply extended to a location short of the fastener-attaching point instead of connecting the both tracks with the common guide track. The modification involves complicacy in construction of the apparatus, since it necessitates two guide grooves and two pusher bars which slidably fit in the grooves so as to convey the fastener pieces from the outlets of the both tracks to the attaching point between the upper and lower dies for crimping use.

BRIEF SUMMARY OF THE INVENTION

The present invention is concerned generally with improvements related to or in a feeder of a fastener-attaching apparatus which needs selective feeding of two different component pieces of fasteners of a given type, and more particularly with improvements in the means of the three-hopper attaching apparatus for selectively feeding the two different fastener pieces.

In accordance with the invention, separate feed tracks are provided for conveying two different pieces of fasteners (not necessarily of the female and male or the socket and ball type) from the hoppers to a location in the vicinity of the point between the upper and lower dies where the fasteners are attached to garments, the discharge ends of the tracks are arranged in parallel, one over the other, opening into a guide groove extending substantially horizontally toward the attaching point, and the shifting of the feed tracks is done at the discharge ends. Under the invention the guide groove portion in the vicinity of the discharge ends is refined in design and construction to guide the fastener pieces discharged from either track smoothly along the groove, so that the fastener pieces can be fed positively and smoothly by a single pusher bar and a single guide groove.

The invention will now be described in detail below with reference to the accompanying drawings.

While an embodiment of the invention handling snap fasteners is described hereinafter, it is to be understood that such description is for illustration purposes only.

DETAILED DESCRIPTION OF THE INVENTION

Figure 1:
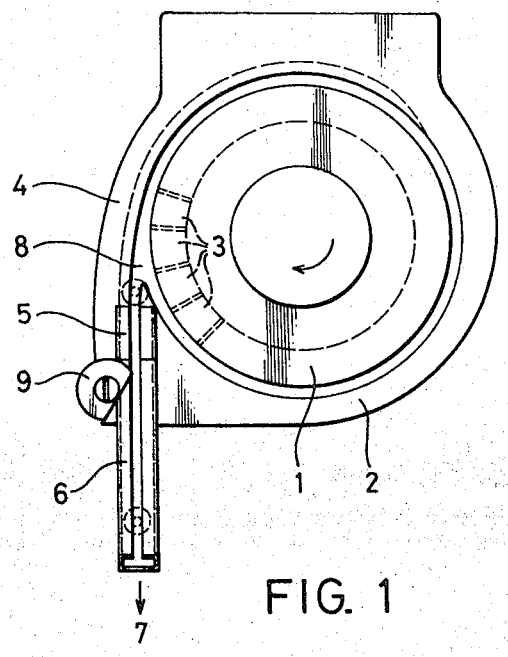
FIG. 1 is a front view of a prior art rotary hopper.

Referring first to FIGS. 1 to 4, a three-hopper type apparatus for attaching snap fasteners in place, to which the present invention is applicable, will be briefly described. The apparatus itself is conventional. Each of the three hoppers, common in basic construction as shown in FIG. 1, accommodates a multiplicity of snap fasteners in a case or compartment defined between a hopper body 1 and vertical planes of a housing 2. The fasteners are fed out, through a number of directional control grooves 3 formed equidistantly on the circumference of the rotary hopper body 1 that faces the housing, along a guide plate 4 and a track connector 5, to a fastener feed track 6, and thence to a point 7 where such fastener is attached to a garment (i.e., where a crimping tool is disposed). The rotary hopper body is intermittently driven in the direction of the arrow, so that the fasteners that have fallen by gravity into the individual directional control grooves 3 in their lowermost positions are carried upward in mill wheel fashion and released, in succession, from the grooves into a guide groove 8. The track is secured to the housing by a screw 9.

Figure 2:
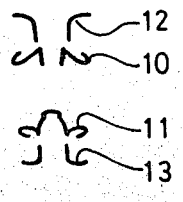
FIG. 2 is a diagrammatic sectional view of the two main pieces and the respective backing members of a fastener.

The snap fastener, as illustrated by way of exemplification in FIG. 2, consists of a female piece 10, a male piece 11, and their attaching or backing pieces 12, 13.

Since the backing pieces 12, 13 are identical in shape, they are handled together, and the male, female, and backing pieces 10, 11, and 12, 13 are contained in the three separate hoppers.

Figure 3:
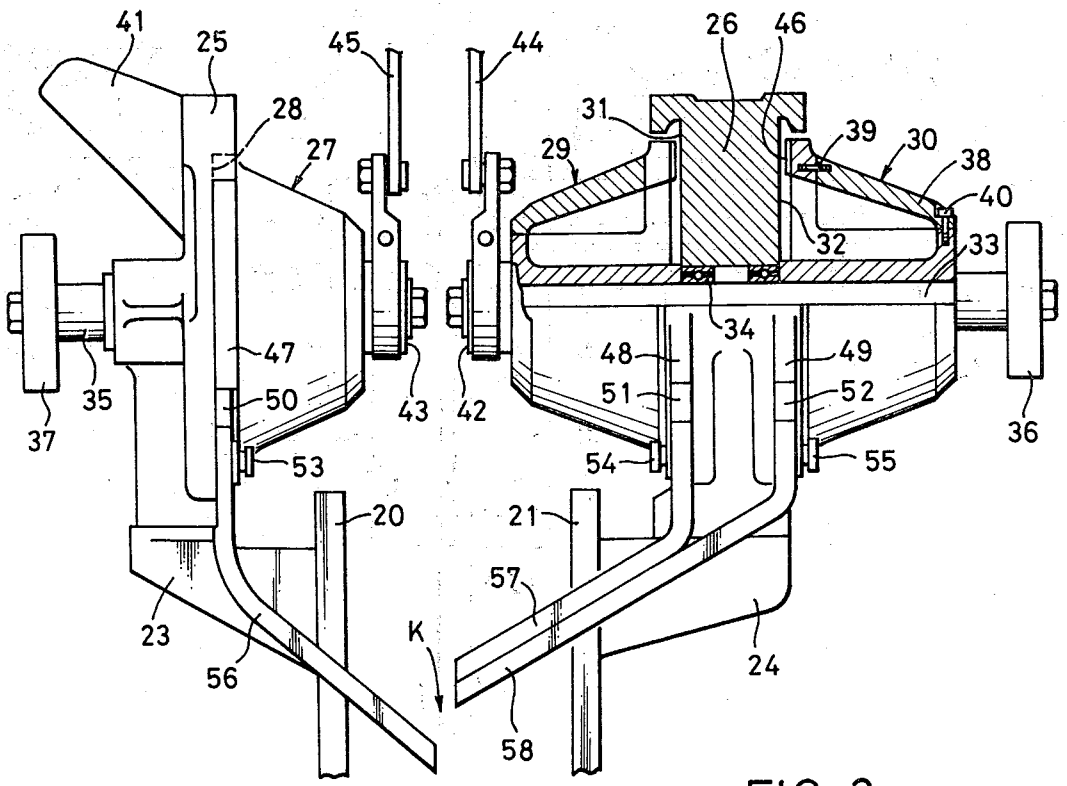
FIG. 3 is a front view of a conventional three-hopper type feeder for the main pieces and backing members of fasteners.

FIG. 3 is a front view of an automatic fastener feeding mechanism forming part of the snap fastener-attaching apparatus. The means for holding a garment to be furnished with the snap fasteners, dies (upper and lower) for crimping the snap fastener pieces together, and die drive means for opening and closing the dies are not shown but are all conventional. (Refer to FIG. 4.)

Support frames 20, 21 are integrally secured to the base (not shown) of the snap fastener-attaching apparatus. Between these frames are disposed (upper and lower) crimping dies and their driving mechanisms shown in FIG. 4. The frames 20, 21 support L-shaped brackets 23, 24, respectively. The vertically extended portion 25 of the L-shaped bracket 23 is formed with a circular recess 28 defining one end wall of a hollow of the hopper body 27 accommodating the backing pieces of the fasteners. Similarly, the vertically extended portion 26 of the L-shaped bracket 24 for the female and male pieces is formed with circular recesses 31, 32 defining one end walls of hollows of the hopper bodies 29, 30 for female and male pieces of the fasteners (e.g., the hopper body 29 being for holding the male pieces and the hopper body 30, for the female pieces). Because the three hoppers are analogous in many details of the circular recess and vertical portion, the common parts will be described below only in connection with the hopper body 30 and its associated parts. The vertical wall portion 26 of the L-shaped bracket 24 has a center opening through which a shaft 34 extends horizontally and is supported for rotation by bearings 34. In the hopper body 27, too, a shaft 35 is rotatably supported. The hopper body 30 is fitted on the shaft 33 and is secured in place by setscrews (not shown). The other hopper bodies 27, 29 are likewise mounted. Part of the hopper 30 is cut off to provide a sectoral opening, in which a cover 38 is shown detachably fitted by a pin 39 and a screw 40. This cover 38 is removed where the female pieces of snap fasteners are to be replenished or discharged from the hopper. The hopper bodies 27, 29, too, may have similar covers. Also, all of the hoppers may be equipped with the means 41 or 38 of the same structure for supplying the female, male, or backing pieces of the snap fasteners. On the inner end portions of the shafts 33, 35 are fixedly mounted one-way clutches 42, 43, which in turn are connected to prime movers (not shown) through crank chains 44, 45, so as to drive the rotary hopper bodies intermittently in the same direction as indicated in FIG. 1. Each rotary hopper body is in the form of a truncated cone and is formed with directional control grooves 46 on the flat periphery facing the circular recess 32. The geometry of the directional control grooves depends on the type of female, male, or backing pieces of the snap fasteners to be handled.

For such hopper construction reference is to be had to FIG. 1 showing a typical hopper and corresponding grooves 3.

To the vertical portions 25, 26 of the L-shaped brackets 23, 24 are fixed guide plates 47, 48, 49 and track connectors 50, 51, 52 similar to those shown in FIG. 1. The brackets are formed with grooves connected with the lower ends of the track connectors 50, 51, 52, and tracks 56, 57, 58 are fitted into these grooves. The tracks, in turn, are fixed to the vertical portions of the L-shaped brackets by setscrews 53, 54, 55 similar to the one designated 9 in FIG. 1. Each track is T-shaped in cross section similarly to the T-groove of the corresponding connector 50, 51, or 52. The design of the T-groove of each track is dictated by the size and shape of the female, male, or backing pieces of the snap fasteners to be handled. The tracks 56, 57, 58 are all bent midway, extending toward the location K where the fastener components are assembled by crimper means (not shown), terminating at prescribed points.

Figure 4:
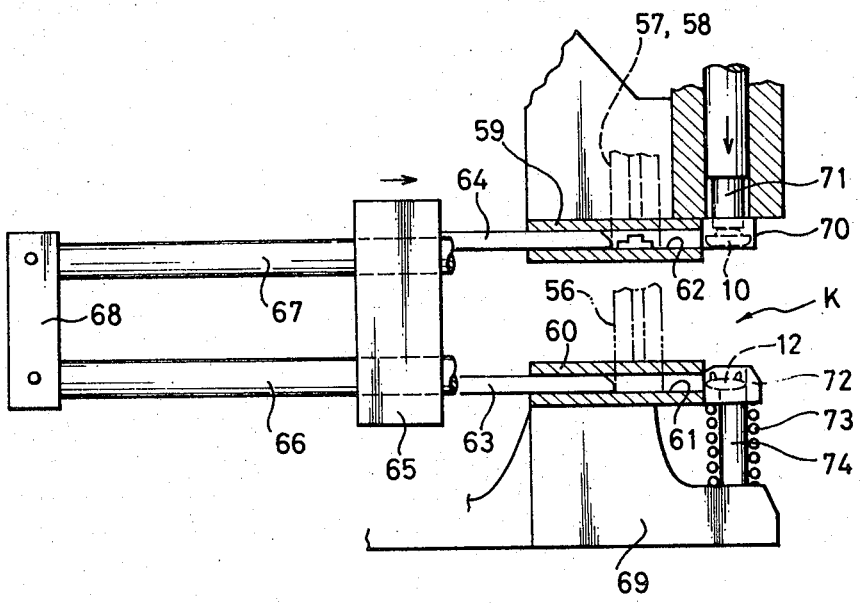
FIG. 4 is a schematic view of a mechanism for delivering fasteners from track outlets to the attaching point and of parts in the vicinity of that point.

In order to deliver the snap fasteners from the discharge outlets of the tracks 56, 57, 58 to the fastener-attaching point K, or into the space between the upper and lower dies of the crimper, a pusher unit is employed. FIG. 4 diagrammatically illustrates such a unit. The discharge outlets of the tracks 56-57 and 58 are open, respectively, in guide grooves 61, 62 of fastener guides 59, 60 attached to the housing 69. In the guide grooves 61, 62 are slidable fitted pusher bars 63, 64, both secured to a block 65. The block 65, in turn, has openings through which guide rods 66, 67, supported at one end by a bracket 68 secured to the housing 69 (and likewise supported at the other ends), extend, so that the block can slide over the rods 66, 67. The front ends of the guide rods 61, 62 are open at the fastener-attaching point K and, as the slide block 65 is driven in the direction of the arrow by a prime mover (not shown), the male or female piece 10 or 11, and the backing piece 12 from the track 57 or 58, and 56 are fed to the attaching point K.

The housing 69 is provided with an upper die, consisting of the working end of a plunger 71 and a holder 70 which can elastically hold each male or female piece 10 or 11 of a snap fastener and is slidable with respect to the plunger 71. The housing also securely supports a lower die which consists of a holder 72 likewise capable of elastically holding and being buckled with a spring 73, and the working end of a stationary rod 74.

Important features that characterize the present invention are the shifting mechanism at the point where the tracks 57, 58 and the guide groove 62 meet, and the feeder comprising the single plunger 64 and the guide groove 62 for delivering the two different component pieces of snap fasteners.

FIGS. 5 through 12 illustrate essential parts of the fastener-attaching apparatus according to the invention. As shown, the guide 59 comprises a base member 75 and side members 76, 77, 78, 79. Between the members 78 and 79, there is provided a guide groove having substantially the same cross sections as that of the pusher bar 64, and between the members 76 and 77, a guide groove of an inverted-T cross section for conducting the pusher bar 64 and fasteners. The side members 76, 78, 79 are fixed, but the side member 77 is pivotally supported by a pin 81 and urged by a spring 80 toward the groove 62 to accommodate fasteners of different sizes. The space between the side members 76 and 78 provides a guide face, on which a fastener limiter slide 82 is fitted so as to move horizontally at right angles to the pusher bar 64. The limiter 82 is inwardly biased by a spring 83 and is kept stationary by a stop 84. The inner end portion of the limiter 82 projects into, and narrows down, the guide groove 62, so that the fastener pieces discharged from the tracks 57, 58 can be exposed, one after another, in the groove 62. Each time the pusher bar 64 has pushed off a fastener piece, the limiter 82 retracts from the guide groove 62.

To the midpoint of the guide 59 between the side members 77 and 79 is secured the lower end of a connector block 57′ connected to both tracks 57 and 58. Outlets 89, 90 of the T-grooves 87, 88 for delivering male and female pieces of the fasteners are arranged up and down and are both open in the guide groove 62.

Figure 5:
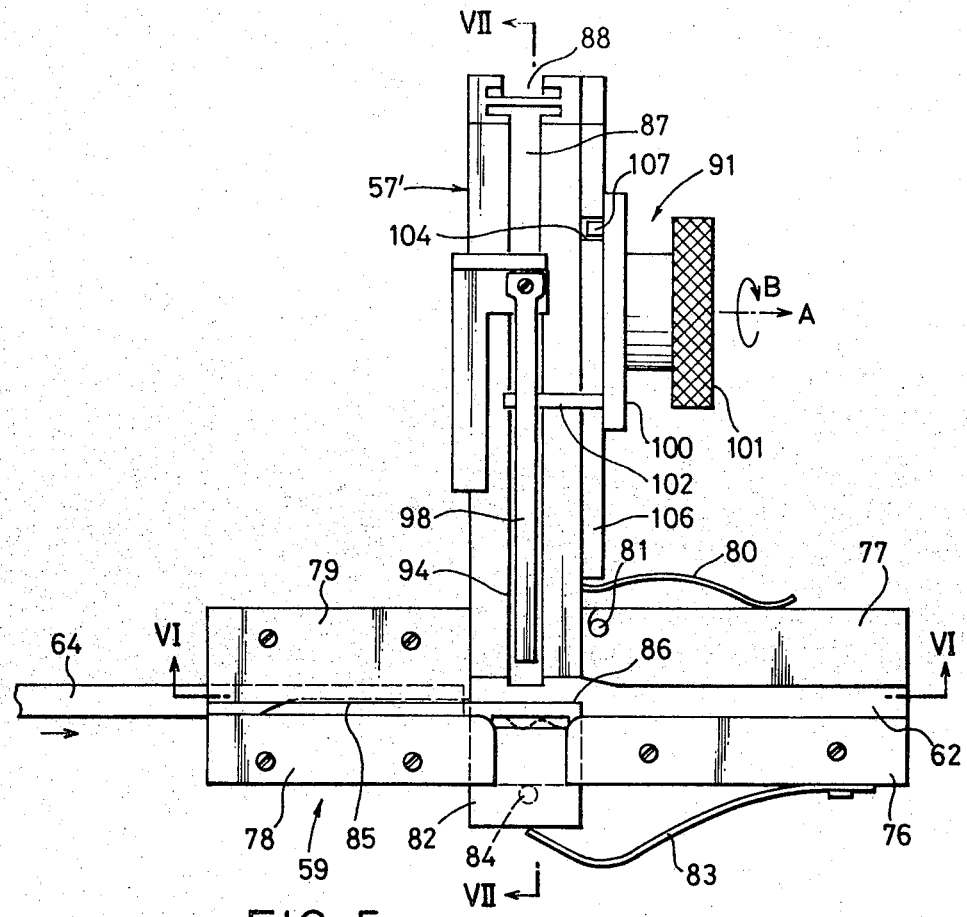
FIG. 5 is a plan view of the parts in the vicinity of track outlets and of a shifting mechanism and a pusher embodying the invention.
Figure 7:
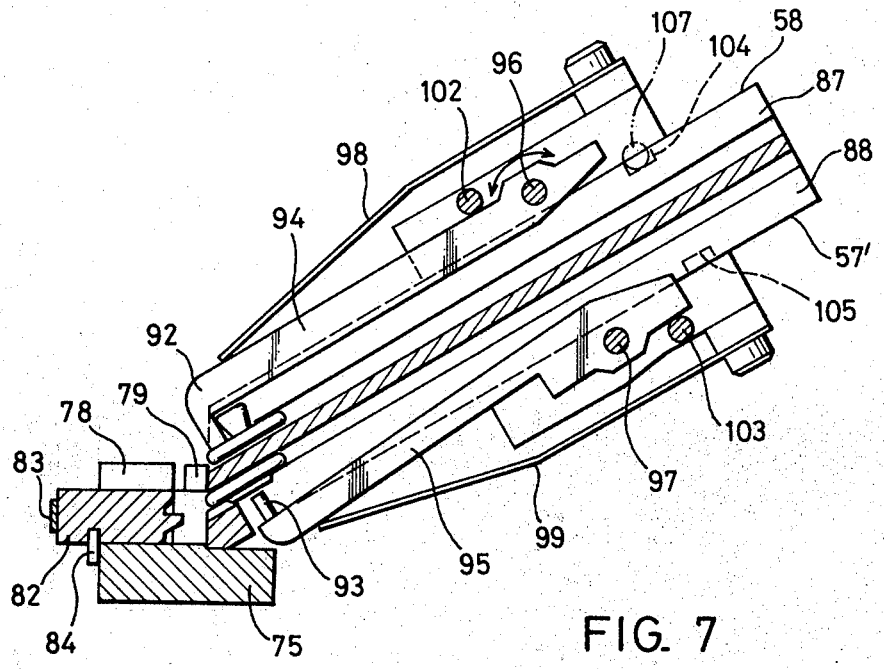
FIG. 7 is a side sectional view taken on the line VII—VII of FIG. 5.
Figure 8:
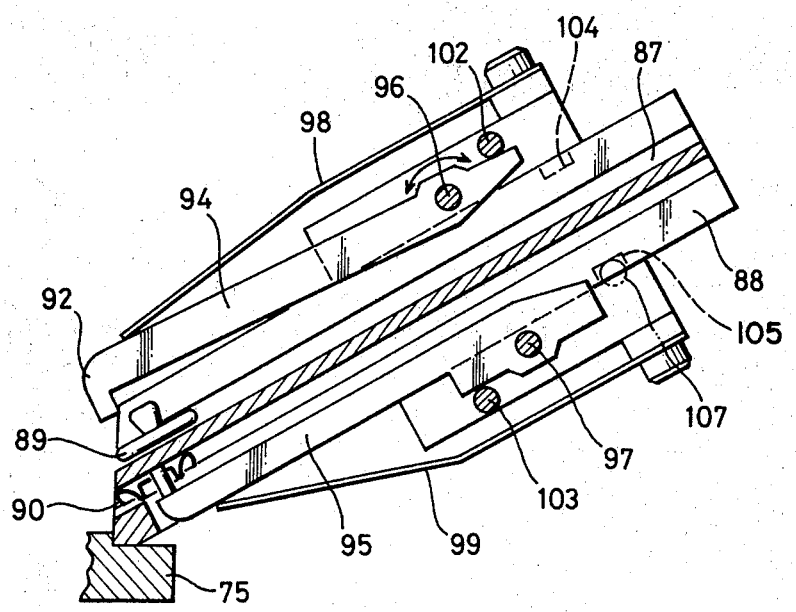
FIG. 8 is a view similar to FIG. 7 but showing the levers shifted in position.
Figure 9:
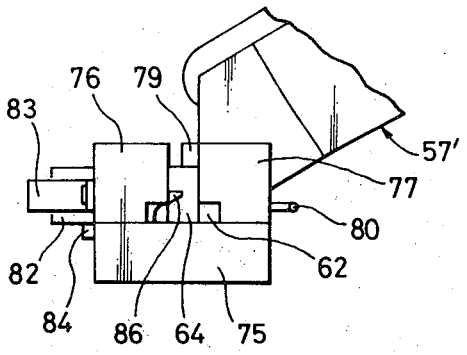
FIG. 9 is a right end view of the arrangement shown in FIG. 6.
Figure 11:
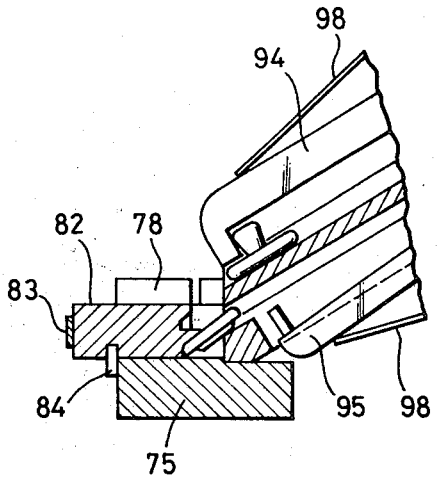
FIG. 11 is a fragmentary sectional view similar to FIG. 7 but showing how a female piece of a fastener is fed.

The connector block 57′ is provided with a shifting mechanism 91. As better shown in FIGS. 7 and 8, levers 94, 95 which have inward projections 92, 93 adapted to enter the outlets 89, 90 of the T-grooves 87, 88, respectively, are pivotally connected to the tracks 58, 57 with pins 96, 97 and are biased toward the grooves 87, 88 of the connector block 57′ by leaf springs 98, 99. As depicted in FIGS. 5, 7, and 8, a turnable disc 100 carrying a knob 101 is pivotally connected to one side of the block 57′ and is normally biased by a spring (not shown) against the block. The disc 100 has a pair of retaining rods 102, 103 located at points symmetrical to the axis of the disc and extended to the outer sides of the levers 94, 95. At the center of an angle the rods make to each other with respect to the disc, there is provided a stop pin 107. In order to receive the pin 107, a side plate 106 is formed with corresponding recesses 104, 105 (indicated by chain lines in FIGS. 7 and 8, the recess 104 being shown in FIG. 5). Now, if the working track in the state of FIG. 7 is to be shifted to the other track, the operator pulls the knob 101 in FIG. 5, against the force of a spring (not shown), in the direction of the arrow A until the stop pin 107 is disengaged from the recess 104. Next, the knob 101 is turned clockwise (in the direction of the arrow B) to bring the retaining rods 102, 103 onto cam lands of the levers 94, 95, setting the latter two free. This enables the tooth 93 at the lower end of the lever 95 to enter the T-groove 88 under the urging of the leaf spring 99 to thereby stop a female piece of a snap fastener. As the knob is turned farther, the rods 102, 103 are moved past the cam lands and beyond the pivot pins 96, 97 into contact with the levers 94, 95 again, with the consequence that the lever 94 is disengaged from the T-groove 87 while the lever 95 is held in the T-groove 88. Since the leaf springs 98, 99 are in use, it is not essential that the rod 102 in FIG. 7 be in contact with the lever 94 nor the rod 103 in FIG. 8 be in contact with the lever 95. Finally, the operator releases the knob 101, when the stop pin 107 fits in the recess 105 of the side plate 106, keeping the turnable disc 100 in place. For the shifting from the state in FIG. 8 to that in FIG. 7, it will be clear to those skilled in the art that the mere reversal of the knob turning so far described is necessary.

The shifting mechanism, with the separate retaining levers for the respective tracks, is capable of infallibly stopping each fastener piece, even when the tracks are full of the pieces, and can effect the shift without difficulty. Further advantages include simplicity in operation as well as in construction.

Figure 10:
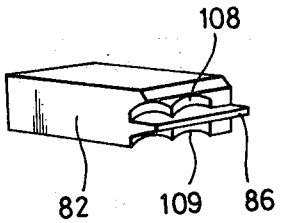
FIG. 10 is an enlarged perspective view of the fastener limiter slide.
Figure 12:
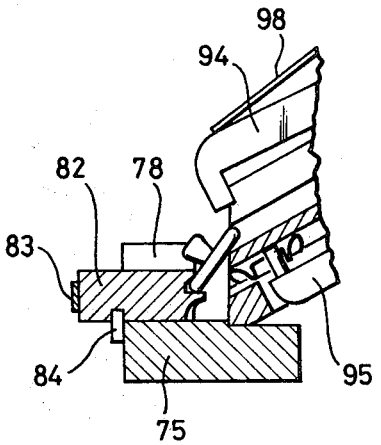
FIG. 12 is a view similar to FIG. 11 but showing how a male piece is fed.

Next, the mechanism for smoothly conducting the two different pieces of fasteners that have fallen from the tracks into the guide groove 62 toward the attaching point will now be described. As shown in FIG. 10, the inner end of the fastener limiter 82 has a planar projection 86 that fits in a tapered groove 85 of the pusher bar 64 and also divides the inner end face into two portions, upper and lower. The two portions are formed, respectively, with arcuate recesses 108, 109 aligned with the track discharge outlets 89, 90. These recesses extend partly into the guide grooves 62, so that the fastener pieces that have fallen from the T-grooves of the tracks are stopped, the female piece in the position shown in FIG. 11 or the male piece as shown in FIG. 12, in either case only one fastener piece being introduced into the guide groove.

Figure 6:
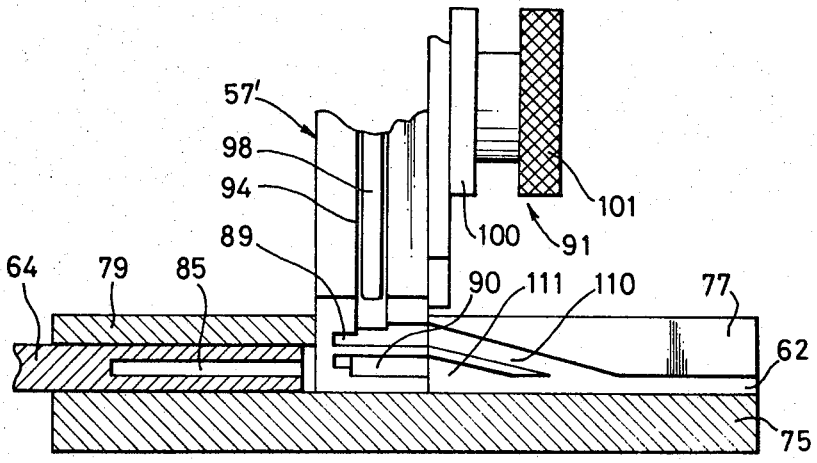
FIG. 6 is a front sectional view taken on the line VI—VI of FIG. 5.

As FIG. 6 shows, the track outlets 89, 90 are communicated with guide slots 110, 111 formed on the inner faces of the side members. Consequently, when a fastener piece held in the space between the outlet 89 or 90 and the recesses 108 or 109 is pushed by the pusher bar 64, it is fed smoothly, with one edge guided by those slots.

The operation of the apparatus is as follows. The operator first effects shifting by manipulating the knob 101 of the shifting mechanism in the manner already described to bring the levers 94, 95 to the positions indicated in FIG. 7 or 8, as the case may be. One of the female or male pieces of snap fasteners from the hopper body 29 or 30 (FIG. 3) is discharged from either open outlet 89 or 90 and is held by the recesses 108 or 109 of the spring-biased limiter 82 as in FIG. 11 or 12. Then, the pusher bar 64 is power driven so that its groove 85 slides along the inner end 86 of the fastener limiter 82 to push the fastener piece. The fastener piece, in turn, is disengaged from the recesses 108 or 109 to urge the limiter 82 outwardly. In this way the female or male piece is guided by the guide slot 110 or 111 to the attaching point K in a proper posture, with the large-diameter part or head of the fastener piece conducted smoothly along the broad zone of the T-groove.

According to the invention, as has been described hereinbefore, it is possible to feed fastener pieces smoothly and infallibly with a single pusher bar, where two different components of fasteners are to be selectively fed, by uniquely designing the structures of outlets of two fastener feed tracks, guide grooves, fastener limiter, and pusher bar. Provision of the mechanism for alternately shifting the fastener feed tracks permits the shifting and the switching of operation from fastener feed to stop and vice versa without difficulty.

It will be clear to those skilled in the art that many variations and modifications are possible within the spirit of the invention.

What is claimed is:

1. In a fastener-attaching apparatus equipped with a feeder for selectively delivering two different component pieces of fasteners from two separate feed hoppers to an attaching point, the improvement in said feeder which comprises a pair of tracks having a pair of vertically parallel fastener-guiding T-grooves which extend from the delivery openings of said two feed hoppers and terminate in vertically juxtaposed fastener discharge outlets, a shifting mechanism for selectively closing and opening said T-grooves of said tracks, a guide having a guide groove provided at right angles to said T-grooves and extending to said fastener-attaching point, with said fastener discharge outlets open in said guide groove, a fastener limiter slide located opposite to said discharge outlets and urged by a spring slidably and partly into said guide groove, said limiter slide having separate fastener-piece-receiving recesses corresponding, respectively, to the upper and lower discharge outlets, and a pusher bar slidable in said guide groove and which, when driven through said guide, causes said limiter slide to retract and pushes each fastener piece to said attaching point.

2. A fastener feeder according to claim 1, wherein said guide groove is inverted-T-shaped in cross section, having a zone broad enough to accommodate the large-diameter parts or heads of said component pieces of fasteners, and a narrow zone of said guide groove includes a guide slot extended obliquely from said fastener discharge outlets to said broad zone.

3. A fastener feeder according to claim 1 or 2, wherein the inner end of said fastener limiter slide has a horizontal planer projection halfway up the height, with fastener-receiving recesses formed above and below said projection, and said pusher bar has a groove adapted to receive said planer projection.

4. A fastener feeder according to claim 1 or 2, wherein the vertically parallel portions of said tracks are formed integrally into a connector block, and said shifting mechanism comprises a pair of pivoted levers having inward projections adapted to enter two T-grooves in the vicinity of the fastener discharge ends, springs biasing said levers toward said T-grooves, and a manually turnable member provided with retaining rods which selectively hold the end of either lever to open one of said T-grooves while closing the other.

5. A fastener feeder according to claim 3, wherein the vertically parallel portions of said tracks are formed integrally into a connector block, and said shifting mechanism comprises a pair of pivoted levers having inward projections adapted to enter two T-grooves in the vicinity of the fastener discharge ends, springs biasing said levers toward said T-grooves, and a manually turnable member provided with retaining rods which selectively hold the end of either lever to open one of said T-grooves while closing the other.

* * * * *